US007149454B2

(12) United States Patent
Yon et al.

(10) Patent No.: US 7,149,454 B2
(45) Date of Patent: Dec. 12, 2006

(54) LIQUID ELECTROPHOTOGRAPHY PRINTER HAVING EXHAUST SYSTEM WITH OXIDATIVE CATALYST FILTER

(75) Inventors: Kyung-yol Yon, Gyeonggi-do (KR); Young-ha No, Gyeonggi-do (KR); Kwang-ho No, Gyeonggi-do (KR); Jeong-hun Pang, Gyeonggi-do (KR); Joong-hwan Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 106 days.

(21) Appl. No.: 10/716,457

(22) Filed: Nov. 20, 2003

(65) Prior Publication Data

US 2004/0146314 A1 Jul. 29, 2004

(30) Foreign Application Priority Data

Jan. 25, 2003 (KR) ..... 10-2003-0005061

(51) Int. Cl.
*G03G 21/20* (2006.01)

(52) U.S. Cl. ..... 399/93

(58) Field of Classification Search ..... 399/91–93, 399/98, 320

See application file for complete search history.

(56) References Cited

U.S. PATENT DOCUMENTS 4,415,533 A * 11/1983 Kurotori et al. ..... 399/93
5,198,195 A * 3/1993 Yoda et al. ..... 399/296
6,041,201 A * 3/2000 Kim ..... 399/93
6,535,703 B1 * 3/2003 Yamamoto et al. ..... 399/93

FOREIGN PATENT DOCUMENTS

JP 02173663 A * 7/1990
JP 06300307 A * 10/1994

* cited by examiner

*Primary Examiner*—David M. Gray
*Assistant Examiner*—Ryan Gleitz
(74) *Attorney, Agent, or Firm*—Staas & Halsey LLP

(57) ABSTRACT

An exhaust system of a liquid electrophotography printer includes: an exhaust line to discharge air inside an engine cell to an outside thereof; at least one exhaust fan, which is installed inside the exhaust line to generate and move the air inside the engine cell; a heating coil to heat the air to be discharged through the exhaust line to ignite impurities contained in the air; and an oxidative catalyst filter to filter and deodorize the impurities. The heating coil may be installed inside the exhaust line and coated with platinum on the outer surface. The oxidative catalyst filter may be installed inside the exhaust line, and may be a metallic honeycomb carrier coated with a catalyst mixture, or a non-woven heating mat coated with a catalyst mixture. The heating coil and the oxidative catalyst filter are typically sequentially installed adjacent to each other.

12 Claims, 1 Drawing Sheet

FIGURE
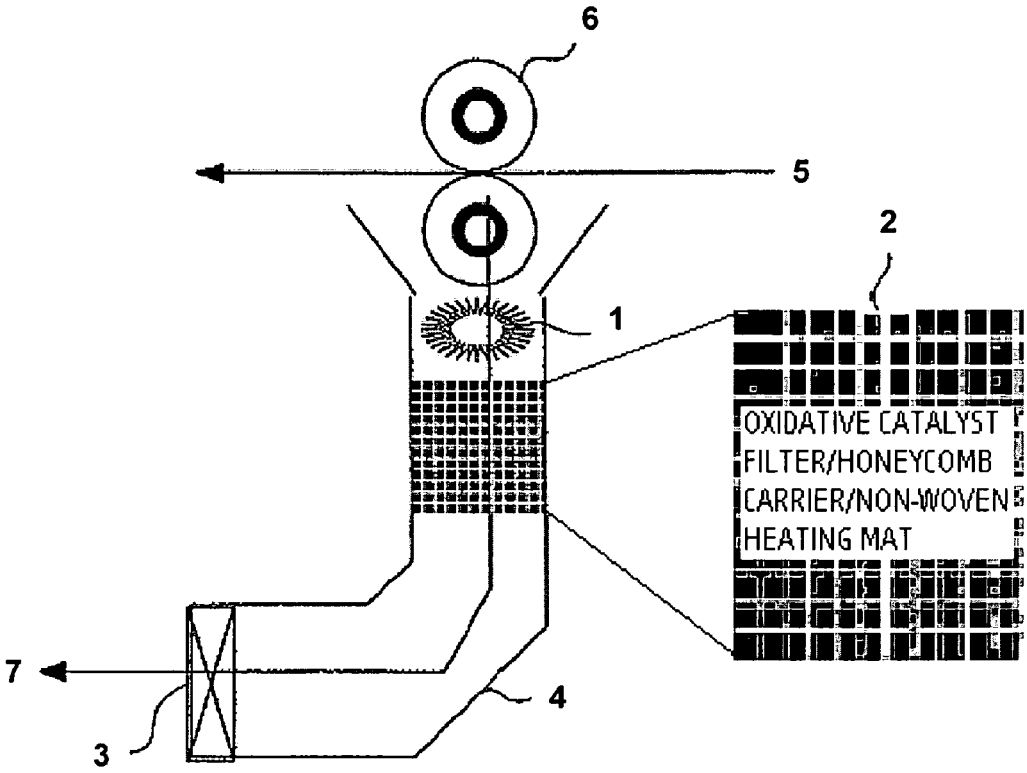

LIQUID ELECTROPHOTOGRAPHY PRINTER HAVING EXHAUST SYSTEM WITH OXIDATIVE CATALYST FILTER

CROSS-REFERENCE TO RELATED APPLICATIONS

This application claims priority from Korean Patent Application No. 2003-5061, filed on Jan. 25, 2003, in the Korean Intellectual Property Office, the disclosure of which is incorporated herein in its entirety by reference.

BACKGROUND OF THE INVENTION

1. Field of the Invention

The present invention relates to a liquid electrophotography printer and more particularly, to a liquid electrophotography printer that removes a harmful exhaust gas efficiently through the combination of a direct combustion method and a catalytic oxidation method while minimizing a heating time of a catalyst filter through efficient use of a heat source.

2. Description of the Related Art

Generally, a liquid electrophotography printer, such as a color laser printer, prints the desired image on a medium using a liquid toner. In this case, a liquid toner prepared by dispersing a pigment, a resin, and a charge control agent (CCA) in a hydrocarbon carrier liquid is mainly used. In particular, excessive carrier liquid remains on an image in a fixation procedure. When the image is thermally treated for fixation, the carrier liquid is discharged outside the printer in a gas phase.

Such a gaseous carrier liquid is a type of volatile organic compound that is generally likely to contaminate an environment and cause various diseases due to its harmfulness to the human body. In addition, due to the severe odor of the volatile organic compound, when a liquid color laser printer is used in an enclosed room, users feel much unpleasantness. Therefore, the removal of such an odor in a liquid color laser printer is required.

Various deodorization methods are known in the art. For example, such methods include a method of using a perfume to mask an odor in order for a person not to smell an unpleasant odor, a method of physically adsorbing an odor ingredient on the surface of a deodorizing product, and methods of using chemicals. With respect to the methods of using chemicals, such methods include an odor fading method by neutralization, oxidation, and the like, and an oxidative degradation method of an odor ingredient into water and carbon dioxide by combustion.

With respect to the combustion of an odor ingredient, a direct combustion method and/or a catalytic oxidation method may be utilized. In the direct combustion method, an odor ingredient is ignited at a temperature greater than its ignition point, i.e., 600 to 800° C. using a flame. In the catalytic oxidation method, an odor ingredient in an oxygen containing gas is ignited or thermally degraded at a relatively low temperature of 150 to 400° C. in the presence of a catalyst, which causes the odor to fade.

The aforementioned various deodorization systems have been applied to currently used liquid electrophotography printers. Among these deodorization systems, for removal of an odor by degradation of an organic compound, a platinum catalyst filter may be used. A cylindrical heater in a hollow platinum catalyst filter is used to heat a platinum catalyst to 200° C. In the case of a commonly used ceramic honeycomb-type platinum catalyst filter, a significant amount of time is required to heat a platinum catalyst to 200° C.

However, if a platinum catalyst filter is not immediately heated to 200° C. upon operation of a printer, a gaseous carrier liquid generated at an early stage is discharged without being oxidatively degraded, thus causing an odor.

According to another method for deodorization in a liquid electrophotography printer, a generated gaseous carrier liquid is treated in a manifold and a condensing bath, in addition to treatment with a deodorizing agent. In this case, however, there are problems in that the inner structure of the printer becomes excessively complicated, and the production cost of the main body of the printer increases.

SUMMARY OF THE INVENTION

The present invention provides a liquid electrophotography printer, in which deodorization efficiency is improved, and a heating time of a catalyst filter is shortened.

According to an aspect of the present invention, an exhaust system for a liquid electrophotography printer, comprises: an exhaust line to discharge air inside an engine cell to an outside thereof; at least one exhaust fan, which is installed inside the exhaust line to generate and move the air inside the engine cell; a heating coil to heat the air to be discharged through the exhaust line to ignite impurities contained in the air; and an oxidative catalyst filter to filter and deodorize the impurities.

The heating coil may be installed inside the exhaust line and coated with platinum on the surface thereof.

The oxidative catalyst filter may be installed inside the exhaust line and may be a metallic honeycomb carrier coated with a catalyst mixture or a non-woven heating mat coated with a catalyst mixture.

The heating coil and oxidative catalyst filter may be installed to be adjacent to each other.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawing of which:

The FIGURE is a schematic diagram of a liquid electrophotography printer having a heating coil and a catalyst filter according to an embodiment of the present invention.

DETAILED DESCRIPTION OF THE EMBODIMENTS

Reference will now be made in detail to the embodiments of the present invention, examples of which are illustrated in the accompanying drawing, wherein like reference numerals refer to the like elements throughout. The embodiments are described below to explain the present invention by referring to the drawing.

The FIGURE shows an exhaust system of a liquid electrophotography printer according to an embodiment of the present invention. In the FIGURE, the exhaust system comprises an exhaust line 4 providing a flow pathway 7 to guide a gaseous hydrocarbon carrier liquid, generated near a hot fixation unit 6, in a predetermined direction. The exhaust system also comprises at least one exhaust fan 3, which is installed inside, generally at an end of the exhaust line 4, to generate and move air inside the exhaust line 4.

In addition, the exhaust system comprises a heating coil 1, which is installed inside the exhaust line 4, generally near the fixation unit 6, to heat/combust air being discharged through the exhaust line 4 to combust impurities contained in the air, and an oxidative catalyst filter 2 to filter and deodorize the impurities.

In the exhaust system, according to an embodiment of the present invention, impurities are easily filtered and deodorized by combination of a direct combustion method using the heating coil and a catalytic oxidation method using the oxidative catalyst filter. At the same time, a heating time for catalytic oxidation is shortened because the oxidative catalyst filter efficiently uses heating sources of the heating coil and the fixation unit, which are adjacent to each other.

The heating temperature of the heating coil may be in the range of 150 to 300° C. If the heating temperature is less than 150° C., it is difficult to obtain a sufficient heating effect. On the other hand, even if the heating temperature exceeds 300° C., an additional heating effect is not obtained.

Generally, it is known that the catalytic oxidation method is suitable for deodorization by degradation of a hydrocarbon organic compound. The principle of removal of an odor of a hydrocarbon organic compound using such a catalytic oxidation method is that the organic compound is converted into carbon dioxide and water at a temperature much lower than that for general combustion by lowering an activation energy required for oxidative degradation of an odor ingredient using a catalyst.

In this case, a catalyst does not directly participate in the oxidative degradation reaction, but serves to facilitate the oxidative degradation reaction. After the reaction, a combustible hydrocarbon ($C_mH_{2n}$) is degraded into water and carbon dioxide in accordance with the following Chemical Formula 1.

$$C_mH_{2n}+(m+n/2)O_2 mCO_2+nH_2O+\text{calories} \qquad \text{Chemical Formula 1}$$

Here, the choice and life maintenance of a catalyst are important factors to be considered. An activation sequence of various catalysts that may be utilized for oxidation of methane ($CH_4$) is as follows:

$$Pd>Pt>Co_3O_4>PdO>Cr_2O_3>Mn_2O_3>CuO>SeO_2>FeO_2>Fe_2O_3>V_2O_5>NiO>Ag>MoO_3>TiO_2$$

Among these catalysts, palladium (Pd) has the best excellent activity, but has poor stability and low resistance to a catalyst poison. Cobalt oxide ($Co_3O_4$) and manganese oxide ($Mn_2O_3$) have a disadvantage of a low activity at a high temperature. Therefore, in a general catalytic oxidation method, a platinum catalyst with excellent activity, heat resistance, and resistance to a catalyst poison, which is supported on a carrier (gamma alumina etc.) is typically utilized.

According to an embodiment of the present invention, in addition to the above oxidative catalyst, the heating coil may be coated with platinum on the surface.

The oxidative catalyst filter 2 of an embodiment of the present invention may be a metallic honeycomb carrier coated with a catalyst mixture or a non-woven heating mat coated with a catalyst mixture.

The oxidative catalyst filter is installed inside the exhaust line, typically adjacent to the heating coil near the fixation unit. The installation sequence of the heating coil and the oxidative catalyst filter includes installation of the heating coil near the fixation unit, and then installation of the oxidative catalyst filter adjacent to, and at, the rear part of the heating coil. By doing so, when air flow is induced toward outside the printer by the exhaust fan, which is positioned at an end of the exhaust line, a gas generated in the fixation unit is heated through the heating coil. As a result, the hot gas and a heat from the heating coil serve to increase the temperature of the oxidative catalyst. Therefore, the oxidative catalyst filter may efficiently use a heat source from the heating coil, and thus, a heating time for catalytic oxidation is shortened.

However, the oxidative catalyst filter may be installed near the fixation unit, and then, the heating coil may be installed adjacent to, and at the rear part, of the oxidative catalyst filter. By installing the heating coil and oxidative catalyst filter adjacent to each other, the oxidative catalyst filter may efficiently use a heat source from the heating coil, and thus, a heating time for catalytic oxidation is shortened.

In particular, because the oxidative catalyst efficiently uses the heat sources of the heating coil and the fixation unit, a desired temperature may be reached within about 1 minute. This is a contrast to a heating time of at least 30 minutes in a conventional method for directly heating a catalyst using a contact heating plate.

After installing the exhaust system of the FIGURE in the main body of a printer, a removal efficiency of a harmful exhaust gas was tested. Here, the heating coil was set to 230° C., and a catalyst of platinum supported on a gamma alumina was used. Printing 5 was performed at about 1 minute after heating. At this time, a gas discharged through the exhaust line was collected for about 2 minutes. A flow rate in an adsorption tube was about 200 ml/mm.

In comparison with before the catalytic oxidation, after the catalytic oxidation, a conversion rate of a harmful gas was about 97%, which was measured with gas chromatography. This means that about 97% of an exhaust gas was changed into a compound harmless to the human body after passing through the exhaust system of an embodiment of the present invention.

As is apparent from the above description, the exhaust system for a liquid electrophotography printer, according to an embodiment of the present invention may easily filter and deodorize impurities by utilizing a combination of a direct combustion method and a catalytic oxidation method, and at the same time, may shorten a heating time for catalytic oxidation because the oxidative catalyst filter efficiently uses the heating sources of the heating coil and the fixation unit, which are adjacent to each other.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An exhaust system of a liquid electrophotography printer, comprising:

an exhaust line to discharge air inside an engine cell to an outside thereof;

at least one exhaust fan, which is installed inside the exhaust line to generate and move the air inside the engine cell;

a heating coil heating the air to be discharged through the exhaust line and igniting impurities contained in the air, wherein the heating coil is installed inside the exhaust line and coated with platinum on an outer surface; and an oxidative catalyst filter to filter and deodorize the impurities.

2. The exhaust system of the liquid electrophotography printer according to claim 1, wherein the oxidative catalyst filter is installed inside the exhaust line and is one of: a metallic honeycomb carrier coated with a catalyst mixture and a non-woven heating mat coated with a catalyst mixture.

3. The exhaust system of a the liquid electrophotography printer according to claim 1, wherein the heating coil and the oxidative catalyst filter are sequentially installed adjacent to each other.

4. A method for removing exhaust gas in an exhaust system of a liquid electrophotography printer, comprising:

discharging, by an exhaust line, air inside an engine cell to an outside thereof;

generating air movement, by at least one exhaust fan which is installed inside the exhaust line, to move the air inside the engine cell;

heating the air to be discharged through the exhaust line using a heating coil that is installed inside the exhaust line and coated with platinum on an outer surface, and igniting impurities contained in the air; and filtering and deodorizing the air to be discharged using an oxidative catalyst filter.

5. The method according to claim 4, wherein the oxidative catalyst filter is installed inside the exhaust line and is one of: a metallic honeycomb carrier coated with a catalyst mixture and a non-woven heating mat coated with a catalyst mixture.

6. The method according to claim 4, wherein the heating coil and the oxidative catalyst filter are sequentially installed adjacent to each other.

7. An air purification system of a liquid electrophotography printer exhaust system, comprising:

a heating coil heating air to be discharged and igniting impurities contained in the air, wherein the heating coil is installed inside the exhaust line and coated with platinum on an outer surface; and an oxidative catalyst filter to filter and deodorize the impurities.

8. The air purification system according to claim 7, further including an exhaust line to discharge air inside an engine cell to an outside thereof.

9. The air purification system according to claim 8, further including at least one exhaust fan, which is installed inside the exhaust line to generate and move the air inside the engine cell.

10. The air purification system according to claim 8, wherein the oxidative catalyst filter is installed inside the exhaust line and is one of: a metallic honeycomb carrier coated with a catalyst mixture and a non-woven heating mat coated with a catalyst mixture.

11. The air purification system according to claim 10, wherein the heating coil and the oxidative catalyst filter are sequentially installed adjacent to each other.

12. An exhaust system in an exhaust line of a liquid electrophotography printer, comprising:

a direct combustion-catalytic oxidation unit igniting impurities, filtering and deodorizing exhaust air, wherein the direct combustion-catalytic oxidation unit comprises a heating coil that is installed inside the exhaust line and coated with platinum on an outer surface to ignite the impurities contained in the exhaust air, and an oxidative catalyst filter to filter and deodorize impurities; and an exhaust fan to move the exhaust air.

* * * * *

UNITED STATES PATENT AND TRADEMARK OFFICE

CERTIFICATE OF CORRECTION

PATENT NO. : 7,149,454 B2
APPLICATION NO. : 10/716457
DATED : December 12, 2006
INVENTOR(S) : Kyung-yol Yon et al.

It is certified that error appears in the above-identified patent and that said Letters Patent is hereby corrected as shown below:

Column 5, Line 3, after "of" delete "a".

Signed and Sealed this

Twenty-seventh Day of March, 2007

JON W. DUDAS
*Director of the United States Patent and Trademark Office*